US007575815B2

(12) United States Patent
Henager, Jr. et al.

(10) Patent No.: US 7,575,815 B2
(45) Date of Patent: Aug. 18, 2009

(54) ALUMINIDE COATINGS

(75) Inventors: Charles H. Henager, Jr., Kennewick, WA (US); Yongsoon Shin, Richland, WA (US); William D. Samuels, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 194 days.

(21) Appl. No.: 11/338,952

(22) Filed: Jan. 24, 2006

(65) Prior Publication Data

US 2006/0177686 A1 Aug. 10, 2006

Related U.S. Application Data

(60) Provisional application No. 60/646,716, filed on Jan. 24, 2005.

(51) Int. Cl.
*B32B 15/20* (2006.01)
*B32B 15/01* (2006.01)

(52) U.S. Cl. ..... 428/650; 428/651; 428/653; 501/153; 501/154

(58) Field of Classification Search ..... None
See application file for complete search history.

(56) References Cited

U.S. PATENT DOCUMENTS 3,668,391 A * 6/1972 Kimball ..... 313/318.12
4,500,364 A * 2/1985 Krutenat ..... 148/242
4,612,383 A 9/1986 Laine et al.
4,639,399 A * 1/1987 Aprigliano ..... 428/623
4,788,309 A 11/1988 Laine et al.
4,801,439 A 1/1989 Blum et al.
4,952,715 A 8/1990 Blum et al.
5,008,422 A 4/1991 Blum et al.
5,017,529 A 5/1991 Blum et al.
5,055,431 A 10/1991 Blum et al.
5,128,494 A 7/1992 Blum
5,162,136 A 11/1992 Blum et al.
5,246,738 A 9/1993 Blum
5,319,121 A 6/1994 Blum
5,322,913 A 6/1994 Blum et al.
5,326,525 A * 7/1994 Ghosh ..... 419/23

(Continued)

FOREIGN PATENT DOCUMENTS

EP 0 922 478 6/1999

(Continued)

OTHER PUBLICATIONS

Biran et al., "Catalytic Synthesis of Oligosilazanes Part 2," *J. Mol. Cat.*, vol. 48, pp. 183-197 (1988).

(Continued)

*Primary Examiner*—Jennifer McNeil
*Assistant Examiner*—Jason L Savage
(74) *Attorney, Agent, or Firm*—Klarquist Sparkman, LLP

(57) ABSTRACT

Disclosed herein are aluminide coatings. In one embodiment coatings are used as a barrier coating to protect a metal substrate, such as a steel or a superalloy, from various chemical environments, including oxidizing, reducing and/or sulfidizing conditions. In addition, the disclosed coatings can be used, for example, to prevent the substantial diffusion of various elements, such as chromium, at elevated service temperatures. Related methods for preparing protective coatings on metal substrates are also described.

9 Claims, 4 Drawing Sheets

U.S. PATENT DOCUMENTS

| | | | | |
|---|---|---|---|---|
| 5,405,655 | A | 4/1995 | Blum et al. | |
| 5,635,250 | A | 6/1997 | Blum et al. | |
| 5,639,844 | A | 6/1997 | Blum et al. | |
| 5,750,643 | A | 5/1998 | Blum et al. | |
| 5,874,069 | A | 2/1999 | Mendolia et al. | |
| 5,919,441 | A | 7/1999 | Mendolia et al. | |
| 5,919,572 | A | 7/1999 | Blum et al. | |
| 5,997,604 | A | 12/1999 | Rafferty et al. | |
| 6,395,406 | B1 * | 5/2002 | Sangeeta | 428/650 |
| 6,521,294 | B2 | 2/2003 | Rigney et al. | |
| 6,881,490 | B2 | 4/2005 | Kambe et al. | |
| 2002/0031683 | A1 * | 3/2002 | Lavery et al. | 428/668 |
| 2005/0244296 | A1 * | 11/2005 | Beck et al. | 420/448 |
| 2006/0147333 | A1 * | 7/2006 | Moxson et al. | 419/32 |
| 2007/0298269 | A1 * | 12/2007 | Kool | 428/457 |

FOREIGN PATENT DOCUMENTS

| | | | |
|---|---|---|---|
| EP | 1 591 552 | * | 2/2005 |
| JP | 11-235509 | | 8/1999 |
| WO | 86/06377 | | 11/1986 |
| WO | 88/02003 | | 3/1988 |
| WO | 90/12835 | | 11/1990 |
| WO | 95/30632 | | 11/1995 |
| WO | 97/36572 | | 10/1997 |
| WO | 97/36573 | | 10/1997 |

OTHER PUBLICATIONS

Blum et al., "Catalytic Methods for the Synthesis of Oligosilazanes," *Organometallics*, vol. 5, No. 10, pp. 2081-2086 (1986).

Blum et al, "Glass Strengthening by Polymer-Derived Ceramic Coatings," *J. Am. Ceram. Soc.*, vol. 73, No. 1, pp. 170-172 (Jan. 1990).

Blum et al., "Hydrosiloxane Polymers for Coating Applications," in Silicon in Coating III Proceedings, Paint Research Association, Paper No. 5 (12 pages) (2000).

Blum et al., "Preceramic polymer pyrolysis, Part 1, Pyrolytic properties of polysilazanes," *J. Mat. Sci.*, vol. 24, pp. 1707-1718 (1989).

Blum et al., "Modifications of hydrosiloxane polymers for coating applications," *Surface Coatings International B: Coatings Transactions*, vol. 84, B1, pp. 27-33 (Jan. 2001).

Blum et al., "Modifications of preceramic polymers suitable for corrosion resistant and high temperature coatings," *Materials Research Society Symposium Proceedings*, vol. 576, pp. 281-286 (Apr. 5-9, 1999).

Blum et al., "Nanocomposites by Covalent Bonding between Inorganic Nanoparticles and Polymers," *Mat. Res. Soc. Symp. Proc.*, vol. 676, pp. Y1.8.1-Y1.8.6 (2002).

Blum et al., "A New Catalytic Method for Producing Preceramic Polysilazanes," in Better Ceramics Through Chemistry II, *Mat. Res. Soc. Symp. Proc.*, vol. 73, pp. 389-394 (1986).

Blum et al, "New Structures of Preceramic Polysilazanes Synthesized by Transition Metal Catalysis," *Mat. Res. Soc. Symp. Proc.*, vol. 121, pp. 565-570 (1988).

Blum et al., "Preceramic Polycyclomethylsilazanes: Chemistry of Processing," *Powder Synthesis and Shape Forming Process, The American Ceramic Society*, vol. 62, pp. 67-74 (1996).

Blum et al., "Pyrolytic Characteristics of Polysilazanes," *Inorganic and Organometallic Oligomers and Polymers*, J. F. Harrod and R. M. Laine, Eds., (Kluwer Academic Publishers, Dordrech, The Netherlands, pp. 161-175 (1991).

Blum et al, "The Relationship Between the Structure of Preceramic Polysilazanes, the Pyrolysis Conditions, and Their Final Ceramic Products," *Polymer Preprints*, vol. 32, No. 3, p. 548 (Aug. 1991).

Chow et al., "Polymerization Kinetics of Polysilazane by Transition Metal Catalyzed Dehydrocoupling Reaction," *J. Polymer Sci.*, Part C: Poly. Lett., vol. 26, p. 103-108 (1988).

Dumitrescu et al., "$Al_2O_3$ coatings on stainless steel from Al metal-organic chemical vapor deposition and thermal treatments," *Surface and Coatings Technology*, vol. 125, pp. 419-423 (Mar. 2000).

Johnson et al., "Development and Properties of an Oxide Fiber-Oxide Matrix Composite," *Key Engineering Materials*, vols. 164-165, pp. 85-90 (1999).

Johnson et al., "Interfaces of Polymeric Precursors with Ceramics/Metals," *Scripta Metallurgica et Materialia*, vol. 31, No. 8, pp. 1025-1030 (1994).

Johnson et al., "Low-Cost Matrix Development for an Oxide-Oxide Composite," *Metals and Materials*, vol. 4, No. 6, pp. 1119-1125 (1998).

Johnson et al, "Processing and Properties of an Oxide/Oxide Composite," *Key Engineering Materials*, vols. 127-131, pp. 231-238 (1997).

Johnson et al., "Processing of an Oxide-Oxide Composite," *6th International Symposium on Ceramic Materials and Components for Engines*, edit. K Niihara, S Kanzaki, K Komeya, S. Hirano, and K. Morinaga, pp. 353-358 (1997).

Johnson et al., "Processing of Ceramic and Composites Using Preceramic Polymers," The Fourth Nisshin Engineering Particle Technology International Seminar, NEPTIS-IV, Osaka, Japan, pp. 67-74 (Dec. 6-8, 1995).

Kambe et al., "Refractive Index Engineering of Nano-Polymer Composites," *Mat. Res. Soc. Symp. Proc.*, vol. 676, pp. Y8.22.1-Y8.22.6 (2001).

Laine et al., "Organometallic Polymers as Precursors to Ceramic Materials: Silicon Nitride and Silicon Oxynitride," *Ultrastructure Processing of Advanced Ceramics*, edited by D. D. Mackenzie and D. R. Ulrich, (J. Wiley and Sons) pp. 761-769 (1988).

Laine et al., "Synthetic Routes to Oligosilazanes and Polysilazanes, Polysilazane Precursors to Silicon Nitride," *Inorganic and Organometallic Polymers, ACS Symposium Series*, edited by M. Zeldin, K. J. Wynne, and H. R. Allcock, vol. 360, p. 124-142 (1987).

Lenhart et al, "The Corrosion Resistance of an Aluminum Alloy Coated with Polysilazane-Derived Ceramics," *Corrosion*, vol. 45, No. 6, pp. 503-506 (Jun. 1989).

McGinn et al, "Interactions between Crystalline $Si_3N4$ and Preceramic Polymers at High Temperature," *Mat. Res. Soc. Symp. Proc.*, vol. 346, pp. 409-414 (1994).

Schwartz et al., "Microstructural Development in $Si_3N_4$/Polysilazane Bodies During Heating," *Adv. Ceram. Mat.*, vol. 3, No. 4, pp. 320-323 (1988).

Schwartz et al., "Microstructural Evidence of Interactions in $Si_3N_4$/Polysilazane Systems," *Mat. Res. Soc. Symp. Proc.*, vol. 121, pp. 483-488 (1988).

Schwartz et al., "Thermal Conversion of Preceramic Polysilazanes to $Si_3N_4$: Characterization of Pyrolysis Products," *Mat. Res. Soc. Symp. Proc.*, vol. 73, pp. 407-412 (1986).

Tsai et al., "Microstructural aspect and oxidation resistance of an aluminide coating on 310 stainless steel," *Thin Solid Films*, vol. 366, pp. 164-168 (May 2000).

Wu et al, "Preceramic Polymer Applications—Processing and Modifications by Chemical Means," *Mat. Res. Soc. Symp. Proc.*, vol. 435, pp. 431-436 (1996).

* cited by examiner

ALUMINIDE COATINGS

CROSS REFERENCE TO RELATED APPLICATION

This application claims the benefit of the earlier filing date of U.S. Provisional Application No. 60/646,716, filed Jan. 24, 2005, which is incorporated herein by reference in its entirety.

ACKNOWLEDGMENT OF GOVERNMENT SUPPORT

This invention was made with Government support under Contract DE-AC05-76RLO1830 awarded by the U.S. Department of Energy. The Government has certain rights in the invention.

FIELD

Disclosed are low cost aluminide coatings for metal articles and methods for preparing and using such articles.

BACKGROUND

Corrosion of various apparatus such as metal parts or articles is an issue affecting many industrial applications and processes and costs industry billions of dollars a year. Although corrosion-resistant coatings are currently in use, enhanced performance requires improved coating materials and methods for forming such coating. The rate of corrosion, oxidation and other chemical degradation of available coating materials limits the operation temperature to which coated articles may be exposed, thereby limiting the usefulness of coating in many chemical processing or industrial power generation applications. New coating materials and methods for making such materials are needed in such industrial applications for articles utilized in higher temperature environments, which temperatures in turn improve energy efficiency and reduce net emissions of many industrial processes.

One method utilized to minimize corrosion of metal articles is to increase the articles' corrosion resistance by alloying the articles with different metal additives. For example, the corrosion resistance of nickel-based alloys can be improved by additions of molybdenum and copper and the corrosion resistance of iron-based alloys can be increased by alloying with chromium. Unfortunately, many such metal additives can migrate from the metal article degrading the article's properties and contaminating their environment, undermining usefulness of migration-prone additives in many applications.

Currently, a common method of providing corrosion resistance to metallic articles is to coat the article with a corrosion-resistant material. However, to date such coatings are unable to withstand many common industrial applications. Moreover, coatings are typically applied by chemical vapor deposition processes, which are expensive and cannot be used to coat components with complex shapes. Therefore there is a need for chemically robust coatings and methods for their application.

SUMMARY

Disclosed herein are metal articles that include a metal substrate and a coating, wherein the coating is a chemically robust intermetallic aluminide coating. Also disclosed are methods for preparing such coatings on metal substrates.

In one embodiment the disclosed articles include a metal substrate and a coating including a first layer forming an outer surface of the article. In one embodiment this outer surface is alumina. In other embodiments the outer surface includes a phase of silica and alumina. Additional layers can be present between the outermost layer and the metal substrate. In one embodiment, the coating includes a second layer formed via diffusion of aluminum into the metal substrate. The plural layers may be substantially distinct. In other embodiments, the material of one or more layer may be intermingled with another layer and/or the substrate.

The metal substrate often comprises chromium, in certain embodiments wherein the substrate contains chromium; the first, outermost layer also can include chromium. In embodiments when chromium is present in the outermost layer, it may have a concentration of from about 1 to about 5 atomic percent.

Also disclosed herein are processes for coating a metal substrate to produce the aluminide coatings described above. In one embodiment the process involves contacting an aluminum-containing powder with a silicon-containing polymer to form a slurry and contacting the silicon-containing polymer with a transition metal catalyst in the presence of a hydroxylic solvent to form a silsesquioxane. In certain examples, the transition metal catalyst is a ruthenium catalyst.

The slurry can be applied to the metal substrate before or after contact with the transition metal catalyst to form a slurry-coated substrate. The slurry-coated substrate is then heated to a temperature sufficient to induce at least partial pyrolysis of the silicon-containing polymer. In one embodiment the substrate is heated at a temperature of at least about 700° C. to induce pyrolysis.

Also disclosed herein are products having an intermetallic aluminide coating produced by the described process. Embodiments of such products have increased resistance to oxidizing, reducing, corrosion and sulfidation conditions encountered in many applications. Moreover, in some embodiments such coatings prevent the substantial migration of reactive elements, such as chromium from a coated article.

The foregoing and other objects, features, and advantages of the invention will become more apparent from the following detailed description, which proceeds with reference to the accompanying figures.

DETAILED DESCRIPTION

Figure 1:
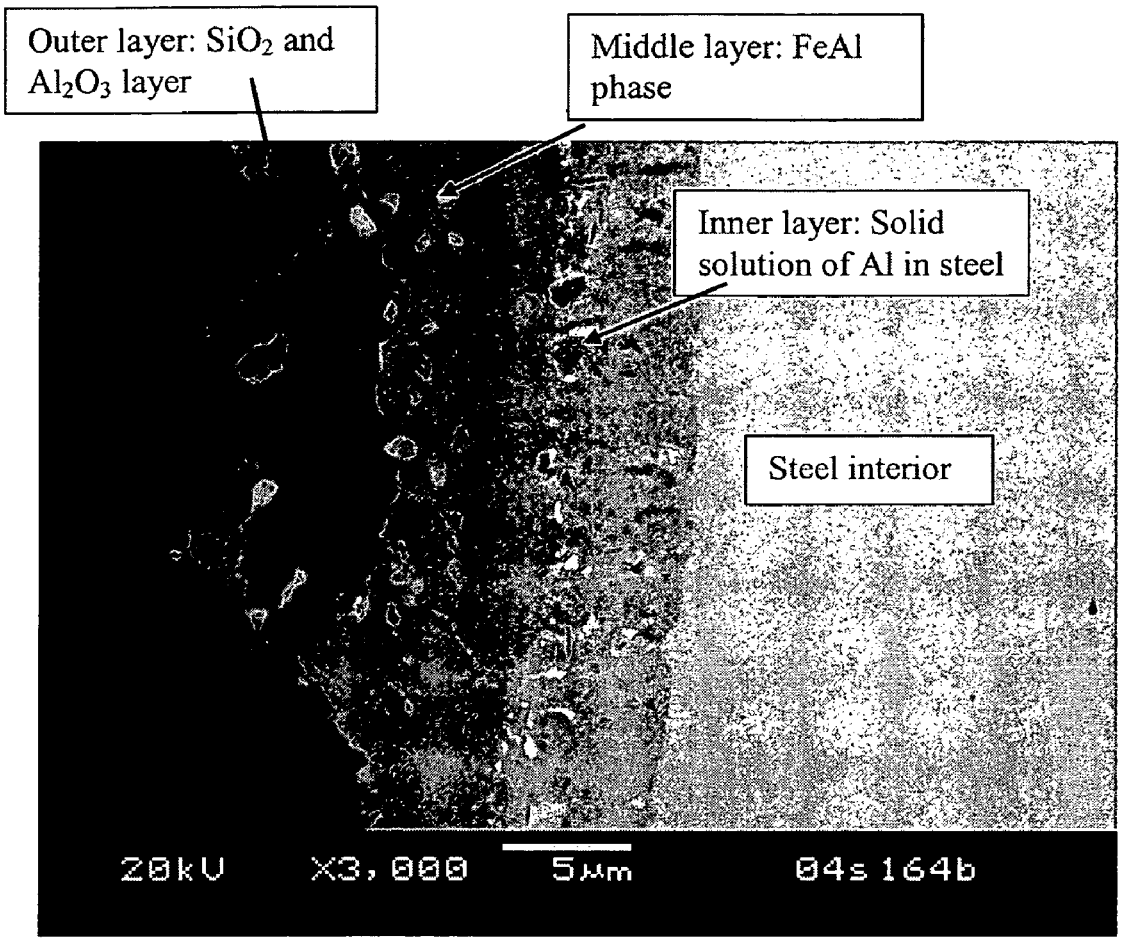
FIG. 1 is a SEM digital image showing a cross section of a presently disclosed coating formed on a 316 stainless steel substrate.

Disclosed herein are intermetallic surface coatings that are capable of resisting the oxidation, carburization, corrosion and/or sulfidation processes generated under harsh conditions. Such coatings can be used to protect metal parts from degradation and/or to minimize metal leaching that can contaminate sensitive applications.

As used herein, the singular terms "a," "an," and "the" include plural referents unless context clearly indicates otherwise. The word "comprises" indicates "includes." It is further to be understood that unless otherwise indicated, all numbers expressing quantities of ingredients, properties, measurements, temperatures, and so forth used in the specification and claims are to be understood as being modified by the term "about" whether explicitly stated or not. Accordingly, unless indicated clearly to the contrary, the numerical parameters set forth are approximations.

I. Introduction

Disclosed herein are methods for preparing coated metal articles. Certain embodiments of the coatings disclosed herein confer properties, such as durability and resistance to chemical degradation upon the coated articles.

In one embodiment, the coating is prepared using aluminum powder and a preceramic silicon-containing polymer. In one aspect of this embodiment a slurry of the aluminum powder and the preceramic polymer is prepared. The slurry may be applied to a metal substrate, which is then heated to form a final coating via a pyrolytic process.

The following explanations of terms and methods are provided to better describe the present disclosure and to guide those of ordinary skill in the art in the practice of the presently disclosed methods and preparation of the disclosed coatings.

The term "lower alcohol" refers to an alkyl group containing from one to ten carbon atoms substituted with one or more hydroxy (—OH) moieties. Examples of lower alcohols include, without limitation straight chain, branched and cyclic alcohols. By way of example such alcohols include methanol, ethanol, 1,2-ethanediol, propanol, 2-propanol, butanol, 2-butanol, pentanol, 2-pentanol, 2-methyl-butanol, cyclopentanol and the like.

The term "silanes" as used herein refers to compounds that contain one or more silicon-silicon bonds. The term "silanyl" refers to a silane radical. "Polysilane" includes oligomeric and polymeric silanes.

The term "silazanes" is used herein to refer to compounds that contain one or more silicon-nitrogen bonds. The term "silazyl" refers to a silazane radical. The term "polysilazane" is intended to include oligomeric and polymeric silazanes.

The term "siloxanes" is used herein to refer to compounds that contain one or more silicon-oxygen bonds and may or may not contain cyclic units. The term "siloxyl" refers to a siloxane radical. The terms "polysiloxane" and "siloxane polymer" as used herein are intended to include oligomeric and polymeric siloxanes.

The term "siloxazanes" as used herein refers to compounds that contain the unit O—Si—N. The term "silazanyl" refers to a siloxazane radical. The term "polysiloxazane" includes oligomeric and polymeric siloxazanes.

The term "carbosilanes" as used herein refers to compounds that contain one or more silicon-carbon bonds in the backbone and may or may not contain cyclic units. The term "carbosilyl" refers to a carbosilane radical. The terms "polycarbosilane" and "carbosilane polymer" as used herein include oligomeric and polymeric carbosilanes.

The term "silyl" unless otherwise specified, includes silazyl, siloxyl, silazanyl and carbosilyl.

The term "superalloy" embraces complex cobalt-, nickel-, or iron-based alloys that include one or more other elements, such as chromium, rhenium, aluminum, tungsten, molybdenum, and titanium. Superalloys are described in various references, e.g., U.S. Pat. Nos. 5,399,313 and 4,116,723, both incorporated herein by reference for their disclosure of particular superalloys. High temperature alloys are also generally described in Kirk-Othmer's Encyclopedia of Chemical Technology, 3rd Edition, Vol. 12, pp. 417-479 (1980), and Vol. 15, pp. 787-800 (1981).

The term "preceramic" is used to refer to polymers that may be converted upon pyrolysis to ceramic products. Polymers employed in the presently disclosed method include preceramic silane, silazane, siloxane and carbosilane polymers which are useful for preparing a wide variety of silicious ceramic materials and articles, e.g., fibers, films, shaped products and the like, comprising materials such as silica, silicon oxynitride or silicon carbide.

II. Coating Materials

In certain embodiments of the disclosed methods coatings are formed by dispersing aluminum-containing particles in a liquid along with polymer and/or monomer constituents to form a slurry. Dispersion of the particles in the slurry aids uniform application of the particles to a metal substrate.

As noted above, certain embodiments of the presently disclosed coatings are prepared using aluminum-containing powders. The aluminum-containing powders may contain aluminum metal, alumina or both. Generally, the powders include individual particles having an average size on the order of about one micron. For example, in certain embodiments, the particles can have an average diameter of from about 0.1 μm to about 5 μm, such as from about 0.5 μm to about 3 μm, or from about 1 μm to about 2 μm. In principle any shape particles can be used, for example, substantially spherical particles can be used. One factor in selecting a particle shape and size relates to the viscosity of the polymer being used. For example, particles such as substantially spherical particles are more effectively suspended in high viscosity slurry mixtures than particles having a lower mass to surface area ratio. Alternatively, the particles can be flakes, which given a similar size are more effectively suspended in less viscous slurries than spherical particles.

Generally, the slurries described herein are dispersions having particle:polymer weight ratios of from about 2:1 to about 10:1, and typically from about 3:1 to about 7:1. For the formation of a particle dispersion, the particular particle concentration depends on the selected application. The concentration of particles affects the viscosity and can affect the efficacy of the dispersion process. In particular, high particle concentrations can increase the viscosity and can make it more difficult to disperse the particles to achieve a desired coating thickness and uniformity. Optional additives, such as dispersants, including solvents, detergents and the like can be used modulate viscosity to facilitate application of the slurry to the substrate.

The composition of the slurry depends on the composition of the dispersant and the particles. Suitable dispersants include, for example, water, organic solvents, such as alcohols and hydrocarbons, and combinations thereof. The selection of preferred solvents generally depends on the properties of the particles. The dispersant and the particles are selected to be compatible for the formation of well dispersed particles. For example, in certain examples alumina particles are dispersed at acidic pH values of about 3-4, silica particles generally are dispersed at basic pH values from about 9-11, and titanium oxide particles generally are dispersed at a pH of about 7. Generally, nanoparticles with little surface charge can be dispersed preferentially in less polar solvents. Thus, hydrophobic particles can be dispersed in nonaqueous solvents or aqueous solutions with less polar cosolvents, and hydrophilic particles can be dispersed in aqueous solvent.

Since many of the commercially available silicon-containing polymers are soluble in organic solvents, many embodiments of the disclosed methods for preparing coatings involve the formation of non-aqueous dispersions. In organic solvents, the dispersion properties have been found to depend on the solvent dielectric constant. In one embodiment organic solvents such as toluene, acetone or cyclohexane are used as dispersants.

In addition, water-based dispersions can include additional compositions, such as surfactants, buffers and salts. For particular particles, such as aluminum, alumina, and silica particles, the properties of the dispersion can be adjusted by varying the pH and/or the ionic strength. As is known to those of skill in the art, ionic strength can be varied by addition of inert salts, such as sodium chloride, potassium chloride or the like. The presence of the linker can affect the properties and stability of the dispersion.

The pH generally affects the surface charge of the dispersed particles. The minimum surface charge is obtained at pH value of the isoelectric point. A decrease in surface charge can result in further agglomeration. Thus, it may be useful to select the pH to yield a desired amount of surface charge based on subsequent processing steps.

Additives, such as surfactants, can be added to the slurry to assist with the dispersion for the particles. Suitable surfactant classes include cationic, anionic and nonionic. Particular examples include Tergitols®, Softanols®, Tritons®, Plurafacs®, Iconols®, Pluronics®, Dowfaxs®, Marcols®, Genepols®, Spans®, Tweens®, Brijis®, Sorbitans®, fatty acids and salts thereof, including quaternary ammonium halide salts, and the like. Additional suitable surfactants for formulating dispersions will be identified by those of skill in the art upon consideration of the present disclosure.

The qualities of the slurry generally depend on the process for the formation of the dispersion. In dispersions, besides chemical/physical forces applied by the dispersant and other compounds in the dispersion, mechanical forces can be used to separate the primary particles, which are held together by van der Waals forces and other short range electromagnetic forces between adjacent particles. In particular, the intensity and duration of mechanical forces applied to the dispersion can significantly affect the degree of dispersion. Mechanical forces can be applied to the powders before dispersion in a solvent to break up agglomerated particles. Alternatively, mechanical forces, such as shear stress, can be applied as mixing, agitation, jet stream collision and/or sonication following the combination of a powder or powders and a liquid or liquids.

Secondary particles may be formed in or otherwise present in the slurry. The secondary particle size refers to the size of the resulting particle agglomerates following dispersion of the powders in the liquid. Smaller secondary particles sizes are obtained if there is more disruption of the agglomerating forces between the primary particles. Secondary particles sizes equal to the primary particle sizes can be accomplished with at least some nanoparticles if the interparticle forces can be sufficiently disrupted. The use of surfactants and shear stress can assist with obtaining smaller secondary particle sizes, which can result in significant advantages in the application of the dispersions for the formation of coatings with uniform properties. For example, smaller secondary particle sizes, and generally small primary particle sizes, may assist with the formation of smoother and/or smaller and more uniform structures using the composites. In the formation of coatings, thinner and smoother coatings can be formed with composites formed with inorganic particle dispersions having smaller secondary particles. In certain embodiments, the average secondary particle diameter is less than about 2000 nm, less than about 1000 nm, or from about 200 nm to about 2000 nm. The primary particle size, of course, is the lower limit of the secondary particle size for a particular collection of particles, so that the average secondary particle size is approximately the average primary particle size. For some particle dispersions, the secondary particle size can be approximately the primary particle size indicating that the particles are well dispersed.

Particle sizes, including secondary particles sizes within a slurry can be measured by established approaches, such as dynamic light scattering. Suitable particle size analyzers include, for example, a Microtrac UPA instrument from Honeywell based on dynamic light scattering and ZetaSizer Series of instruments from Malvern based on photon correlation spectroscopy. The principles of dynamic light scattering for particle size measurements in liquids are well established.

Once the dispersion or slurry is formed, the dispersion may eventually separate such that the particles collect on the bottom of the container without continued mechanical stirring or agitation. Stable dispersions have particles that do not separate out of the dispersion. Different dispersions have different degrees of stability. The stability of a dispersion depends on the properties of the particles, the other compositions in the dispersion, the processing used to form the dispersion and the presence of stabilizing agents. Suitable stabilizing agents include, for example, surfactants. Preferably, dispersions are reasonably stable, such that the dispersions can be used without significant separation during the subsequent processing steps forming the coated products, although suitable processing to form the composite can be used to ensure constant mixing or the like to prevent separation of the particle dispersion.

The silicon-containing starting material may be a monomer, oligomer or polymer. Monomeric starting materials may be polymerized prior to, during, or after application to the substrate. In general, preceramic silicon-containing polymers, or "ceramic precursors," may be prepared by catalytic activation of Si—H bonds, and/or Si—N bonds, as disclosed in U.S. Pat. No. 5,055,431 to Blum et al.; U.S. Pat. No. 5,128,494 to Blum; and U.S. Pat. No. 5,750,643 to Blum and McDermott, the disclosures of which are hereby incorporated by reference. Briefly, silicon-containing starting materials containing Si—H bonds, and/or Si—N bonds, are reacted with a compound of the general formula R—X—H, wherein X is typically O or NH, and wherein R is H, alkyl or aryl, a moiety containing an unsaturated carbon-carbon bond, an amine or an organic or hydroxy metal compound.

In one embodiment, a polymer precursor initially provided contains Si—H groups. The polymer precursor may be a polysilane, a polysiloxane, a polysilazane, a polycarbosilane, like compounds, or mixtures thereof. The polymer precursor is preferably reacted in the presence of a catalyst, with or without a solvent, with a compound of the general formula R—X—H, where X is NR' or O, R is H, organic (containing saturated or unsaturated moieties), haloorganic, siloxyl, silazanyl or carbosilyl, and may contain additional X—H groups, and R' is H, amino, silazyl or silazanyl. The R—X—H compound can insert in the silicon-hydride bond. By this method, polymers having an Si—X bond—although in certain embodiments still containing at least one Si—H bond—are produced, with the simultaneous release of $H_2$. Preferred silicon-based polymers for use as polymer precursors include polysilanes and polysiloxane (silicone) polymers, such as poly(dimethylsiloxane) (PDMS). Polysiloxanes also include polyhydrosiloxanes, such as poly(methylhydrosiloxane) (PHMS), which is particularly suitable for preparing the disclosed coatings.

Suitable catalysts for silicon hydride bond activation include transition metal catalysts as is known to those of skill in the art. In general homogeneous and heterogeneous catalysts both can be used to prepare silsesquioxanes. Particular examples of suitable catalysts include, without limitation $H_4Ru_4(CO)_{12}$, $Ru_3(CO)_{12}$, $Fe_3(CO)_{12}$, $Co2(CO)_8$ and $Rh_6(CO)_{16}$ and mixtures thereof. Combinations of transition metal catalysts also can advantageously be used to accomplish the desired transformation. By way of example $Fe_3(CO)_{12}$ and $Ru_3(CO)_{12}$ can be used in combination in the present method.

III. Substrates and Coatings

Various substrates can be coated as disclosed herein to form degradation-resistant metal articles. The actual configuration of the substrate may vary widely. By way of example, the substrate can be in the form of various turbine engine parts or other components subject to high stress conditions. Particular embodiments are directed to coating an article that can be successfully employed in a high-temperature, oxidative environment. The article includes a metal-based substrate. The substrate may be formed from a variety of different metals or metal alloys, including steel and heat-resistant alloys, such as superalloys, which typically have a maximum operating temperature of about 1000-1150° C.

In particular embodiments, the coatings disclosed herein include plural layers and have at least one layer being characterized as including from about 10 to about 35 atomic percent aluminum, such as from about 15 to about 30 or from about 20 to about 25 atomic percent aluminum. In addition, this coating layer can contain from about 10 to about 35 atomic percent silicon, such as from about 15 to about 30 or from about 20 to about 25 atomic percent silicon. In certain embodiments, a layer is or includes a phase, for example a silica and alumina phase as a substantially homogeneous part of a multilayer coating.

In certain embodiments a substantial portion of the silicon present in the outermost coating layer is in the form of silicon carbide. Indeed, in some embodiments, this layer includes from about 20 to about 60 weight percent silicon carbide, such as from about 35 to about 50 weight percent silicon carbide.

Other constituent elements optionally present in the outermost coating layer include, without limitation chromium and nickel. For example, in certain embodiments of the coating the outermost layer can include less than about 5 atomic percent chromium, such as from about 1 to about 5 atomic percent chromium and/or from about 0.5 to about 1 atomic percent nickel, such as from about 0.6 to about 0.8 atomic percent.

In certain embodiments the coatings include plural distinct layers wherein the layer has a substantially homogeneous chemical composition. Indeed, in certain embodiments, for example wherein the substrate is steel, a second layer is made up of a FeAl phase. Other layers can be formed via diffusion of aluminum into a substrate metal to form an aluminum diffusion layer. A third distinct coating layer also is present in certain embodiments and is made up of a solid solution of aluminum in the metal substrate, for example a solid solution of aluminum in steel. Finally, as is disclosed herein an alumina outer coating is formed under certain conditions.

With reference to FIG. 1, shown is a cross-sectional view of a an embodiment of a coating having a first layer comprising silica and alumina, a second layer comprising FeAl, and a third layer comprising a solid solution of aluminum in steel. This coating, comprising a diffusion aluminide layer was produced by polymer-aluminum slurry application to a 316 stainless steel surface via dip coating. The diffusion layer is formed by heating at 800° C. for 1 hour in nitrogen with the dried, cured polymer slurry coated on the surface of the steel. The distinct layers are clearly visible in the SEM image. Such multilayer coatings, particularly those having the outermost layer observed here, are not observed in other diffusion aluminide coatings.

In one embodiment the coating further comprises a gradient in aluminum composition, the gradient extending from a first aluminum concentration level at an outer surface of the coating to a second aluminum concentration level at an interface between the coating and the substrate, wherein the first aluminum concentration level is greater than the second aluminum concentration level and the second concentration level is at least about 30 atomic percent, such as greater than about 40 atomic percent aluminum. In particular embodiments the second concentration level is at least about 42 atomic percent. In one embodiment, a third aluminum concentration level exists at a further interface between the coating and the steel wherein the aluminum exists as a solid solution in the steel and the third concentration level is at least about 5 atomic percent, such as at least about 10 atomic percent. In one embodiment an aluminum diffusion layer is formed by partial diffusion of aluminum into the metal substrate. This layer can be, for example, less than about 25 μm thick, such as from about 5 to about 20 μm or from 5 to about 15, such as about 10 μm thick.

Figure 2:
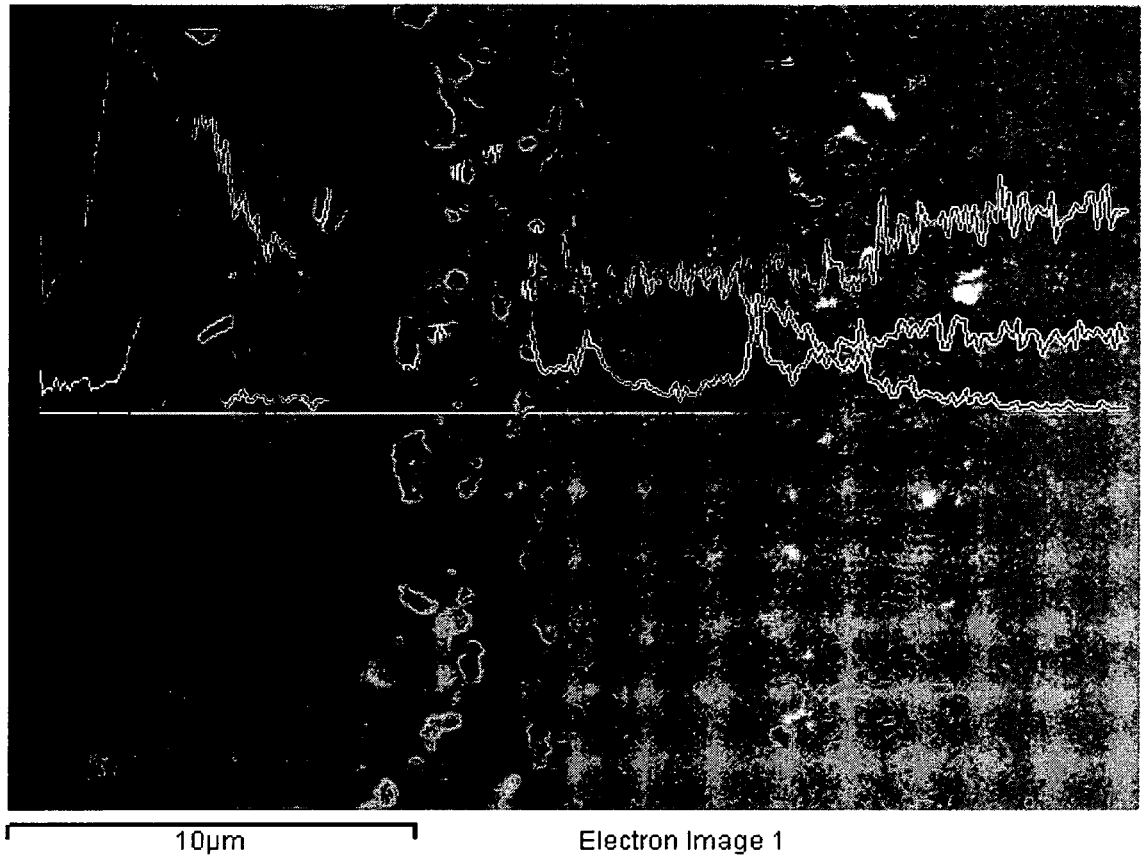
FIG. 2 is an image produced by a SEM EDS line scan across an aluminide coating cross section illustrating the gradient of aluminum, iron and chromium concentrations in the coating.

FIG. 2 illustrates certain embodiments of the disclosed coatings, wherein aluminum concentrations using an SEM EDS line scan method to determine aluminum concentration levels from the outer portion of the coating into the steel substrate.

In certain embodiments, there is substantial interdiffusion of coating components. For example, at elevated temperatures, there is often a great deal of interdiffusion of elemental components between the coating and the substrate. The interdiffusion can change the chemical characteristics of each of these regions, while also changing the characteristics of the oxide scale. In general, there is a tendency for the aluminum from the outermost layer, which is aluminum rich, to migrate inwardly toward the substrate. At the same time, traditional alloying elements in the substrate (e.g., a superalloy), such as cobalt, tungsten, chromium, rhenium, tantalum, molybdenum, and titanium, tend to migrate from the substrate into the coating.

In certain embodiments, the disclosed coatings prevent the substantial migration of alloy elements of the substrate into the coating. For example, in some embodiments the outermost coating layer is substantially free of alloy elements, such as chromium. Non-limiting examples of alloy elements for the substrate are chromium, nickel, cobalt, iron, aluminum, chromium, refractory metals, hafnium, carbon, boron, yttrium, titanium, and combinations thereof. Of that group, those elements which often have the greatest tendency to migrate into the overlying coating at elevated surface temperatures are chromium, cobalt, molybdenum, titanium, tantalum, carbon, and boron. Of particular concern is chromium migration due to this element's high reactivity. Chromium migration or leaching is a serious problem in fuel cells, particularly solid oxide fuel cells, because chromium effectively poisons many catalysts used in such fuel cells. Embodiments of the presently disclosed coatings solve an important problem found in prior art coatings by effectively sequestering chromium (and other migrating elements) and preventing it from contaminating sensitive equipment, such as catalytic materials. In other embodiments the outermost coating layer may include some migrated alloy elements, but substantially prevents such elements from migrating from the coating.

IV. Coating Formation

In general the polymer/particle dispersions can be applied to the article to be coated in any suitable fashion. Suitable methods for applying the dispersion to a metal article include, without limitation, dip coating, brushing or spray coating. Typically, spray coating is used with lower viscosity dispersions, depending upon the requirements of the spray gun used. Typically one coating is sufficient; however plural coatings can be applied in the same fashion as a first coating.

Desirable qualities of a liquid dispersion of aluminum-containing particles for application to a substrate generally depend on the concentration of particles, the composition of the dispersion and the formation of the dispersion. Specifically, the degree of dispersion intrinsically depends on the interparticle interactions, the interactions of the particles with the liquid and the surface chemistry of the particles. Both entropic and energetic consideration may be involved. The degree of dispersion and stability of the dispersion can be significant features for the production of uniform composites without large effects from significantly agglomerated particles.

In one embodiment, a "green" state layer is prepared by subjecting the partially slurry-coated substrate to elevated temperature, such as about 150° C. in the presence of adventitious water, for example in moist air, following application of the slurry to the substrate. This results in polymer crosslinking, which gives a "green" state coating, which can be handled. The partially slurry-coated substrate can be subjected to pyrolysis conditions with or without forming the "green" state coating. Pyrolysis may be temporary or complete. For example, in one embodiment the polymer is only partially pyrolyzed, resulting in a coating containing the polymer used to form the slurry. In other embodiments, pyrolysis is complete.

In another embodiment disclosed coatings can be used to prevent hydrogen permeation in pipelines or tubing. Alumina is an effective permeation barrier for hydrogen and one form of this invention can be used to form the outer alumina scale to provide this barrier at high temperatures and for hard to coat geometries.

V. Examples

The foregoing disclosure is further explained by the following non-limiting examples. Unless indicated otherwise, parts are parts by weight, temperature is given in Celsius or is at room temperature and pressure is at or near atmospheric.

Aluminum metal flake powders obtained with size range of 1-2 μm and 99.99% purity (commercially available from Cerac, Milwaukee, Wis.), and were added to liquid PHMS (commercially available from Gelest or United Chemicals) polymer in a ratio of from 5 grams to 1 gram of polymer (other working embodiments used ratios of from 3 grams to 7 grams of powder to 1 gram of polymer). In this example, 4 grams of cyclohexane were added as a solvent. This amount of powder comprises about 60% by volume of the resultant slurry. The slurry was mixed using small ceramic balls (ca. 4 mm diameter alumina balls) in a polyethylene bottle for 4 hours on a horizontal roller mixer at room temperature. After ca. 4 hours of mixing, about 15 milligrams Ru-carbonyl ($Ru_3(CO)_{12}$) and the dispersion was allowed to mix for about five additional minutes. The solution was then removed from the roller mixer and thinned to the desired viscosity for application by adding from about 1 gram to about 10 grams cyclohexane to 20 grams of the dispersion. The resulting viscosity was about 20 mPa-s(cp). This solution can be applied via dip coating or brushing. Typically, the viscosity should be reduced by adding additional cyclohexane if spray coating is to be used. In this example, the substrate was coated via dip coating using a 1 mm/min withdrawal rate.

After the coating is applied the coated article is processed by curing at 150° C. in moist air, which results in crosslinking of the polymer. This produces a "green" coating that can be handled (with care) without damage prior to final sintering. The green product was subjected to pyrolysis at 800° C. in flowing gas for 30 to 240 minutes in a quartz tube furnace (heated at 5° C./minute). This step was performed under different atmospheres, including argon, air and nitrogen. The sintered product was cooled at a rate of 10° C./minute.

In working embodiments, the green product is heated in an oven at the sintering temperature (for example to from about 700° C. to about 900° C. at a rate sufficient to accomplish heating of the oven to the sintering temperature in about one hour. Sintering is accomplished in air, nitrogen, argon or in the presence of a carbon-containing gas (e.g. acetylene) for a time ranging from 30 minutes to several hours, for example four hours. In general, longer sintering times result in thicker aluminide coatings. The cooling rate typically is about 5° C. or less per minute. The coated product was characterized using energy dispersive X-ray spectroscopy (EDS), scanning electron microscopy (SEM), X-ray diffraction (XRD), transmission electron microscopy (TEM) and focused ion beam (FIB) techniques.

FIG. 2 shows a cross section of an embodiment of one product prepared by the method above. A SEM EDS line scan across this aluminide coating cross-section reveals aluminum chromium and iron concentration gradients. In this embodiment, the aluminum gradient extends about 25 μm into the steel and includes several layers.

The sintering process can be varied by switching from nitrogen to air after one hour in nitrogen and this allows an alumina skin to form more easily on the surface of the coating. It is not necessary to pyrolyze in air to obtain an alumina outer scale since the polymer contains abundant oxygen but the final pyrolysis in air assists this alumina scale formation.

Figure 3:
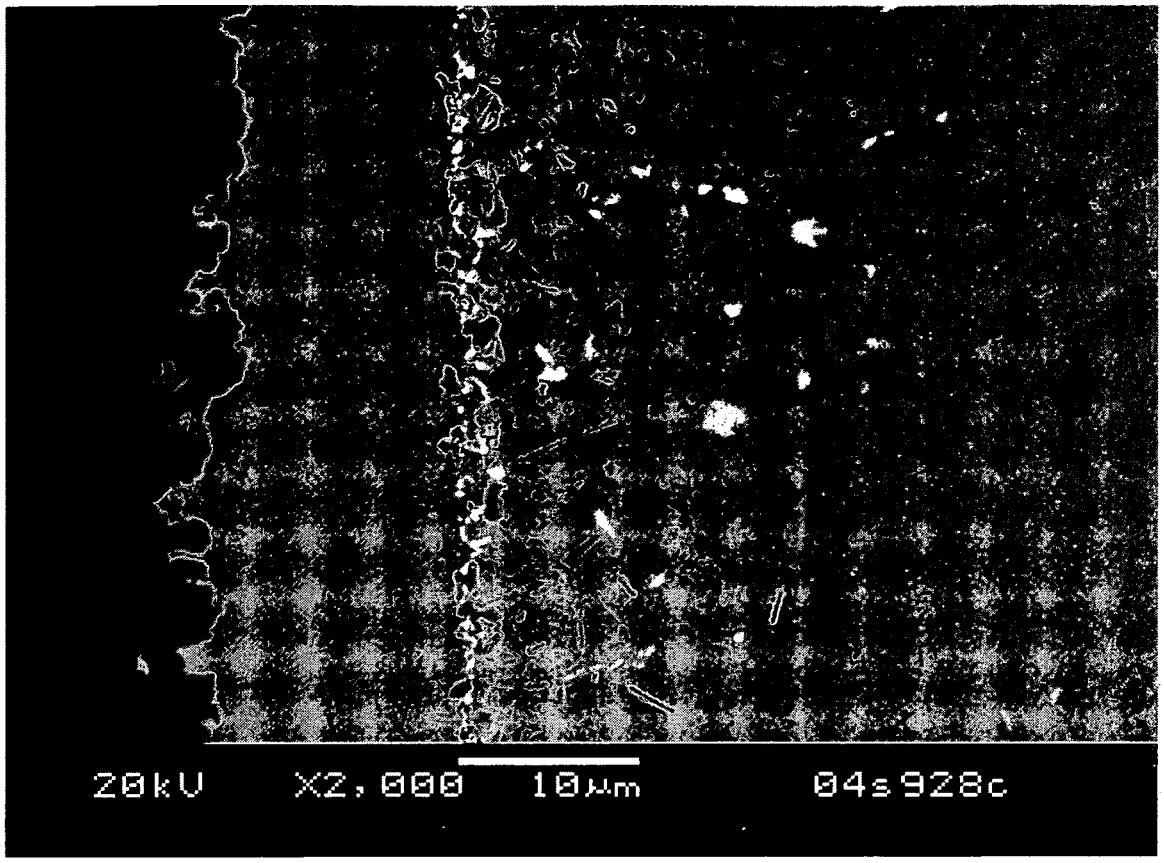
FIG. 3 is a SEM micrograph of a coatings pyrolyzed under nitrogen for 2 hours followed by air for 1 hour at 800° C.
Figure 4:
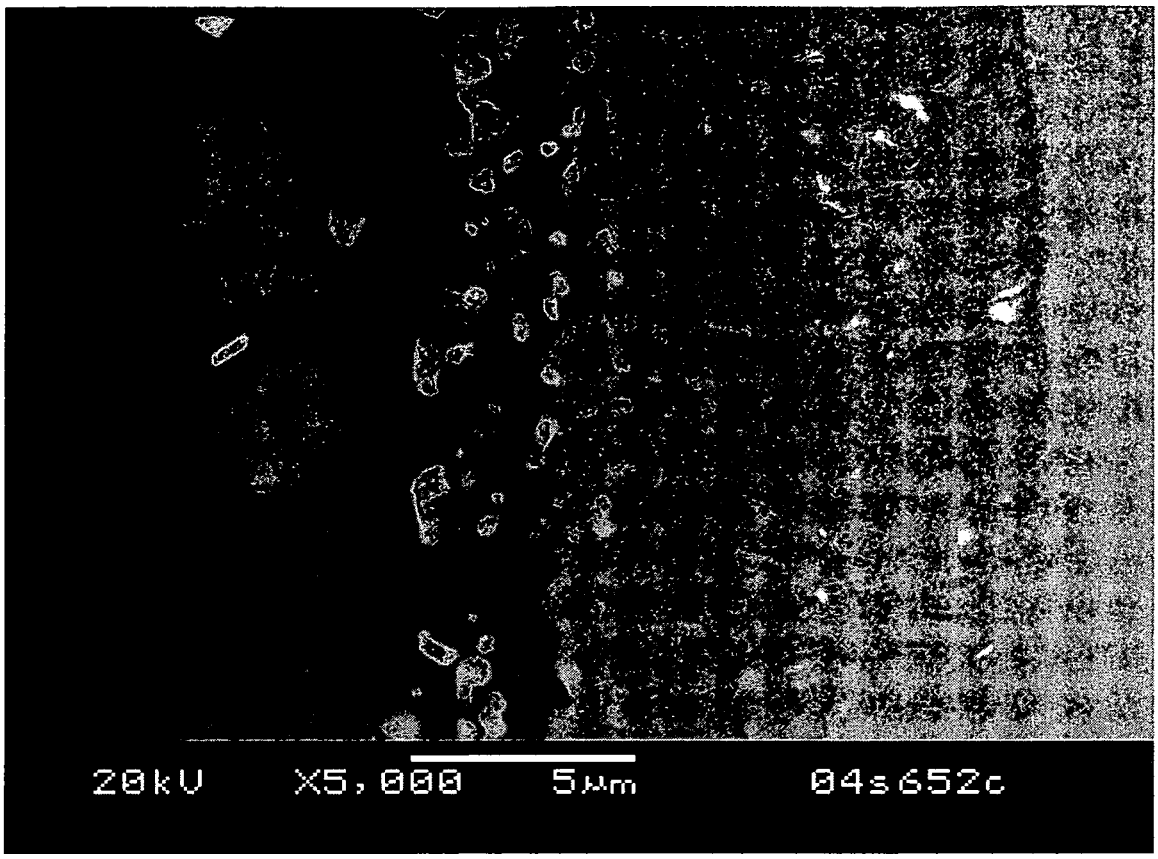
FIG. 4 is a SEM micrograph of a coating prepared using the same mixture as the coating of FIG. 3 but produced via pyrolysis under nitrogen for 2 hours at 800° C.

FIGS. 3 and 4 show two coatings prepared as set forth above. The coating shown in FIG. 3 was pyrolyzed under a nitrogen atmosphere for two hours followed by continued pyrolysis in air for one hour. The coating of FIG. 4 was pyrolyzed under nitrogen for two hours to produce the final coating. The pyrolysis was conducted at 800° C. in both cases. The nitrogen pyrolysis method typically forms a thicker alumina outer layer, however in this case, the longer pyrolysis time of the coating shown in FIG. 3 results in a thicker overall coating.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An article, comprising:

a metal substrate; and an aluminide coating on the metal substrate, wherein the aluminide coating includes a first layer comprising a silica and alumina phase and from about 20 to about 60 weight percent silicon carbide, the first layer forming an outer surface of the aluminide coating.

2. The article of claim 1, wherein the first layer comprises from about 10 to about 35 atomic percent aluminum.

3. The article of claim 1, wherein the first layer comprises from about 1 to about 5 atomic percent chromium.

4. The article of claim 1, wherein the first layer comprises from about 0.5 to about 1 atomic percent nickel.

5. The article of claim 1, wherein the aluminide coating further comprises a second layer between the first layer and the metal substrate, the second layer comprising FeAl.

6. The article of claim 5, wherein the aluminide coating further comprises a third layer wherein the third layer comprises a solid solution of aluminum partially diffused into the metal substrate.

7. The article of claim 1, further comprising a second layer comprising an aluminum diffusion layer diffused into the metal substrate.

8. The article of claim 7, wherein the second layer is less than about 25 μm thick.

9. The article of claim 8, wherein the second layer is from about 5 μm to about 20 μm thick.

* * * * *

UNITED STATES PATENT AND TRADEMARK OFFICE

CERTIFICATE OF CORRECTION

PATENT NO. : 7,575,815 B2
APPLICATION NO. : 11/338952
DATED : August 18, 2009
INVENTOR(S) : Henager, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 400 days.

Signed and Sealed this

Seventh Day of September, 2010

David J. Kappos

David J. Kappos
*Director of the United States Patent and Trademark Office*